US012371967B2

(12) United States Patent
Hitchcock et al.

(10) Patent No.: US 12,371,967 B2
(45) Date of Patent: Jul. 29, 2025

(54) WELLBORE OPERATIONS SYSTEM AND METHOD

(71) Applicant: SAUDI ARABIAN OIL COMPANY, Dhahran (SA)

(72) Inventors: Graham Hitchcock, Aberdeen (GB); Arthur Herman Hale, Angleton, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/652,297

(22) Filed: May 1, 2024

(65) Prior Publication Data

US 2024/0368960 A1 Nov. 7, 2024

Related U.S. Application Data

(60) Provisional application No. 63/463,731, filed on May 3, 2023.

(51) Int. Cl.

| | |
|---|---|
| ***E21B 33/13*** | (2006.01) |
| ***E21B 10/02*** | (2006.01) |
| ***E21B 21/00*** | (2006.01) |
| ***E21B 33/12*** | (2006.01) |

(52) U.S. Cl.

CPC ..... *E21B 33/13* (2013.01); *E21B 10/02* (2013.01); *E21B 21/003* (2013.01); *E21B 33/1204* (2013.01)

(58) Field of Classification Search

CPC ..... E21B 33/13; E21B 10/02; E21B 21/003; E21B 33/1204

See application file for complete search history.

(56) References Cited

U.S. PATENT DOCUMENTS

| | | | |
|---|---|---|---|
| 1,224,509 | A | 5/1917 | Smith |
| 1,526,677 | A | 2/1925 | Painter |
| 2,012,294 | A | 8/1935 | Wright et al. |
| 2,038,792 | A | 4/1936 | Howard et al. |
| 2,146,263 | A | 2/1939 | Norris |
| 2,267,683 | A | 12/1941 | Norris |
| 3,677,355 | A | 7/1972 | Elenburg |
| 8,991,524 | B2 | 3/2015 | Pearce et al. |

*Primary Examiner* — Tara Schimpf
*Assistant Examiner* — Daniel T Craig
(74) *Attorney, Agent, or Firm* — Bracewell LLP; Constance G. Rhebergen; Keith R. Derrington

(57) ABSTRACT

A downhole operation in a wellbore having a lost circulation zone that includes plugging the lost circulation zone with a material that solidifies, and extracting a core from the solidified material to form a bore through the solidified material. The core is extracted with a monolithic coring bit, which retains the core within for removing the core from the wellbore. An example of a material that solidifies are eutectic alloys, such as an alloy of bismuth and tin. Such eutectic alloys have two properties that make them attractive for use in downhole applications. Namely, these alloys expand upon solidifying (rather than shrinking like other metals), and they have relatively low melting temperatures (138° C. to 170° C.).

20 Claims, 8 Drawing Sheets

WELLBORE OPERATIONS SYSTEM AND METHOD

CROSS-REFERENCE TO RELATED APPLICATION

This application claims priority to and the benefit of U.S. Provisional Application Ser. No. 63/463,731, filed May 3, 2023, the full disclosure of which is incorporated by reference herein in its entirety and for all purposes.

BACKGROUND OF THE INVENTION

1. Field of Invention

The present disclosure relates to downhole operations in a wellbore having a lost circulation zone.

2. Description of Prior Art

Hydrocarbon producing wellbores extend subsurface and intersect subterranean formations where hydrocarbons are trapped. The wellbores are usually formed by drilling systems that include a drill string made up of a drill bit mounted to a length of interconnected pipe. Typically, a top drive or rotary table above the opening to the wellbore rotates the drill string. Cutting elements on the drill bit scrape the bottom of the wellbore as the bit is rotated and excavate material thereby deepening the wellbore. Drilling fluid is typically pumped down the drill string and directed from the drill bit into the wellbore; the drilling fluid then flows back up the wellbore in an annulus between the drill string and walls of the wellbore. Cuttings are produced while excavating and are carried up the wellbore with the circulating drilling fluid.

While drilling the wellbore mudcake typically forms along the walls of the wellbore, which results from residue from the drilling fluid and/or drilling fluid mixing with the cuttings or other solids in the formation. The permeability of the mudcake generally isolates fluids in the wellbore from the formation. Seepage of fluid through the mudcake can be tolerated up to a point. Occasionally cracks in a wall of the wellbore allow free flow of fluid (lost circulation) between the wellbore and adjacent formation, the portion of the wellbore where lost circulation occurs is typically referred to as a lost circulation zone. Corrective action is required when the magnitude of the lost circulation compromises well control or introduces other operational issues. The cracks are sometimes from voids in the rock formation that were intersected by the bit, or formed by large differences in pressure between the formation and the wellbore.

Typically after encountering severe circulation losses drilling is stopped and conventional heavy concentration lost circulation material ("LCM") is pumped downhole with the intention to plug the cracks in the rock formation to mitigate mud losses. In some instances, the formation surrounding the wellbore contains natural fractures having such a significant volume that the lost circulation material pumped downhole migrates into the fracture(s) before being set. If the lost circulation problem is significant, a solid plug of material can be set in the wellbore adjacent the lost circulation zone; such as, a cement slurry that solidifies at downhole temperatures or pressures. Drilling this material can introduce its own issues, such as creating debris that collects in the bottom of the well that if circulated uphole is damaging to pumps or other equipment on surface.

SUMMARY OF THE INVENTION

Disclosed herein is an example of a method of operating in a wellbore that includes forming a plug in a portion of the wellbore having a lost circulation zone, forming a core by excavating through the plug with an annular bit member that is configured so that the core has an outer diameter that ranges between around 75% to around 60% of an outer diameter of the plug within the wellbore, extracting the core from the plug to define an axial passage through the plug, and removing the core from the wellbore. In an example, the annular bit member includes upper and lower end sections with outer surfaces and profiles that project radially outward from the surfaces. The profiles optionally make up a plurality of profiles that are helically arranged and spaced apart from one another, and alternatively, the profiles form a fluted configuration and where widths of the profiles on the lower end section are different from widths of the profiles on the upper end section. The annular bit member alternatively includes a mid-section between the upper and lower end sections, where outer diameters of the upper and lower end sections exceed an outer diameter of the mid-section, and where an outer diameter of the mid-section is substantially constant along an axial length of the mid-section. In an example, forming a plug involves injecting a liquified plugging material ("LPM") into the wellbore, collecting the LPM in the portion so that the LPM flows from inside the wellbore into the lost circulation zone, and allowing the LPM to solidify. In embodiments, the plug includes a eutectic alloy having bismuth and tin. The method further optionally includes retaining the core within the annular bit by biasing an uphole end of a lever radially inward, where the lever is in a recess in a sidewall of the bit member and pivotingly secured in the recess on a downhole end with a pin. The method optionally includes inserting a downhole tool through the axial passage. In examples in which the plug includes a eutectic material, the method further optionally includes recycling the core for use in forming another plug.

Also disclosed is a system for use in a wellbore and that includes a string assembly that includes a pipe string, an annular bit member on an end of the pipe string. The annular bit member of this example includes an annular body having an outer diameter strategically dimensioned to be in sliding contact with an inner diameter of the wellbore, a cutting end on a downhole end of the body, an annulus formed axially through the body that selectively receives a core as the cutting end is in cutting engagement with the plug, a bore extending axially through the body having a diameter that ranges between about 60% to about 75% of a passable inner diameter of the wellbore, and a retaining system in selective retaining contact with the core inside the bit. The system of this example also includes a drive system in selective rotational coupling with the string assembly. In an example the bit member is a monolithic member so that all portions of the bit member selectively rotate at the same rotational frequency. In embodiments an inner surface of the bore has a continuous radius along an axial length of the bore. The annular bit member alternative is made up of a mid-section and upper and lower end sections projecting axially from opposing ends of the mid-section, optionally, the upper and lower end sections have outer diameters greater than an outer diameter of the mid-section and where the upper and lower end sections have profiles projecting radially outward from outer surfaces of the upper and lower end sections. In an example, there are a plurality of profiles that are spaced away from one another and that extend helically along the outer surfaces of the upper and lower end sections. In an alternative, the profiles form a fluted configuration. Widths of profiles on the lower end section are optionally different from widths on the upper end section. In an embodiment, the plug includes a eutectoid alloy having bismuth and tin. Examples of the retaining system include a recess in a sidewall of the annulus of the bit, a lever in the recess this at selectively pivoted radially inward by a spring into engagement with the core.

BRIEF DESCRIPTION OF DRAWINGS

Some of the features and benefits of the present invention having been stated, others will become apparent as the description proceeds when taken in conjunction with the accompanying drawings, in which.

Figure 1A:
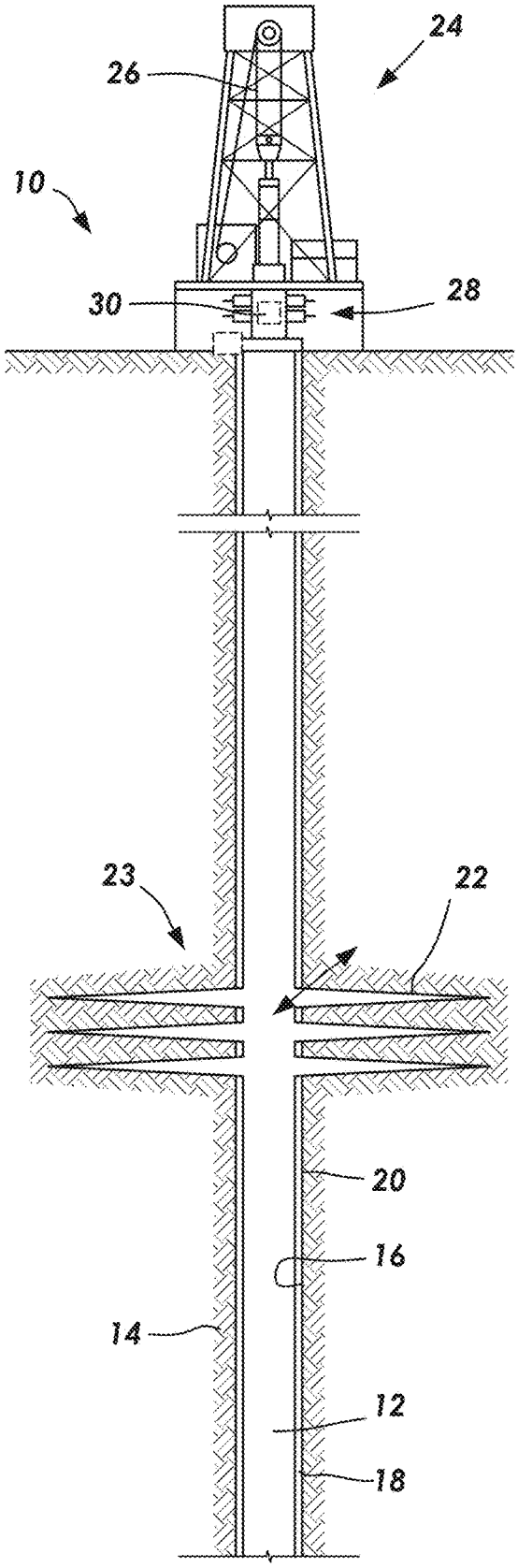
FIGS. 1A and 1B are side sectional views of example of different wellbores, each having a portion in communication with a surrounding formation.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1A is an example of conducting operations in a well system 10 where the well system 10 includes a wellbore 12 that is formed through a subterranean formation 14. Casing 16 is shown lining the wellbore 12 and cement 18 is provided between the outer surface of casing 16 and inner surface of sidewalls 20 of the wellbore 12. A series of perforations 22 are formed from wellbore 12 into the surrounding formation 14 and that intersect the casing 16 and cement 18 and extend radially outward past sidewalls 20. The region of wellbore 12 where perforations 22 are located define a zone 23 where wellbore 12 is in fluid communication with formation. For the purposes of discussion herein zone 23 is referred to as a lost circulation zone 23. A derrick 24 is shown above an opening of wellbore 12 and includes a top drive 26 mounted within the structure of derrick 24. System 10 also includes a wellhead assembly 28 formed over the wellbore 12 opening and that provides pressure control over the wellbore 12. Optional modules 30 are mounted onto wellhead assembly 28, which in embodiments include processors (not shown) for use with devices in the wellbore 12 or surface. In further embodiments, modules 30 include sensors (not shown) for detecting conditions in wellbore 12.

Figure 2A:
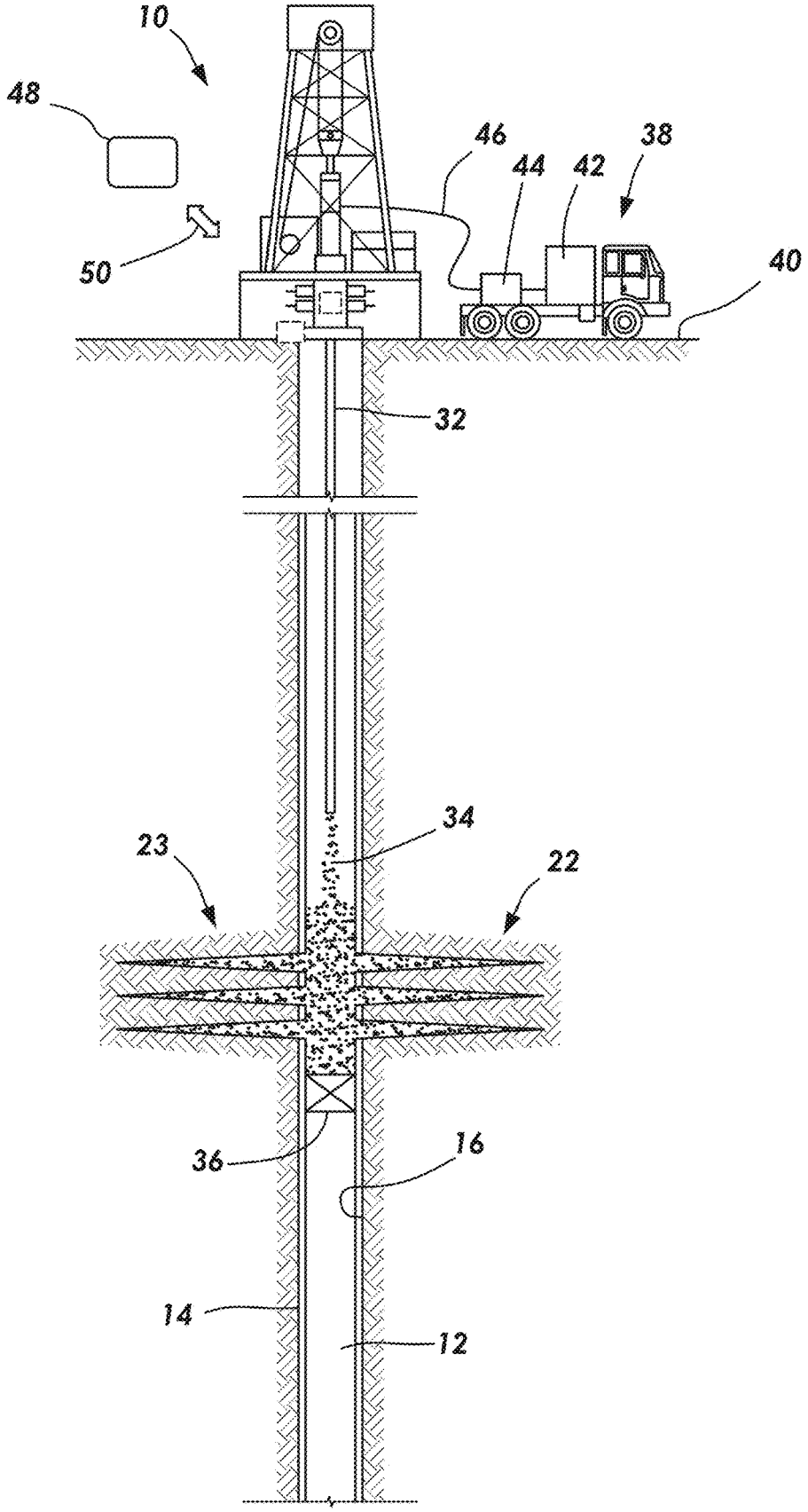
FIGS. 2A and 2B are side sectional views of forming plugs in the wellbore portions of FIGS. 1A and 1B.

FIG. 2A illustrates in a side sectional view an example of an operation of well system 10 in which tubing 32 is being inserted into wellbore 12. A liquified plug material ("LPM") 34 is being injected into wellbore 12 through tubing 32 and shown flowing into the perforations 22. When injected into the wellbore 12 LPM 34 is in a fluid form that later solidifies to form a barrier to fluid communication between wellbore 12 and formation 14 along the zone 23. In FIG. 2A, an optional bridge plug 36 is shown mounted within wellbore 12 downhole of zone 23, which was installed prior to injecting the LPM 34. Bridge plug 36 provides a support on which the LPM 34 accumulates, so that with continued injection, a column of LPM 34 collects in the wellbore 12 above the bridge plug 36, and a portion of which flows into the perforations 22. In one example of operation, LPM 34 is injected from a service truck 38 shown on surface 40, a reservoir 42 on truck 38 holds the LPM 34. A pump 44 on truck 38 pressurizes the LPM 34 and discharges it into a line 46 that carries the pressurized LPM 34 into tubing 32. In an alternative, tubing 32 is part of coiled tubing deployed from a reel (not shown) mounted onto or coupled with truck 38. Further shown in FIG. 2A is an example of a controller 48 for monitoring conditions of the wellbore 12 and via communication means 50 receiving data from downhole and/or sending command signals for operating devices within wellbore 12.

Figure 3A:
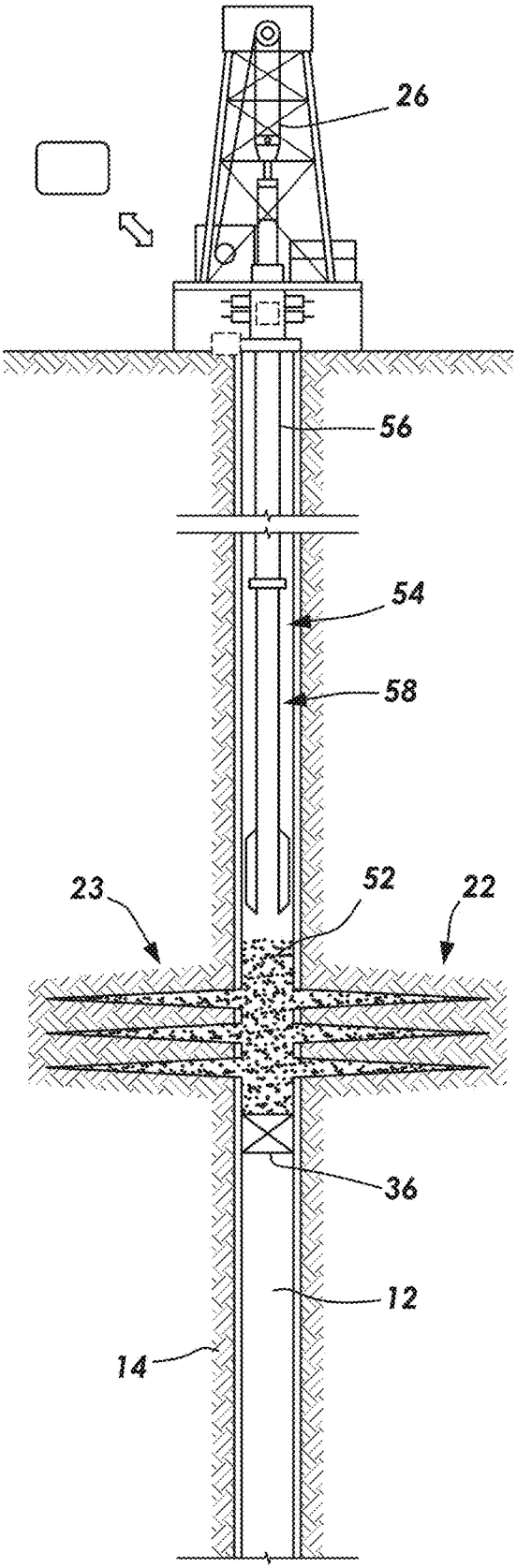
FIGS. 3A and 3B are side sectional views of deploying pipe strings into the wellbores of FIGS. 2A and 2B.

Referring now to FIG. 3A, shown in a side sectional view is an example of the LPM 34 in FIG. 2A solidified within zone 23 to form a plug 52 within wellbore 12, which blocks communication from wellbore 12 into formation 14 along zone 23. In an example, the material making up the plug 52 is a eutectoid alloy, which in examples includes bismuth and tin. Alternatively, the eutectic alloy expands upon solidifying (rather than shrinking like other metals), and has a melting temperature that ranges from about 138° C. to about 170° C. Further shown in FIG. 3A is an example of a string assembly 54 being deployed into wellbore 12 and lowered onto the solidified plug 52. String assembly 54 includes a pipe string 56 and a bit member 58 on a lower end of pipe string 56. In the example shown pipe string 56 includes pipe joints joined in series to one another end to end.

Figure 1B:
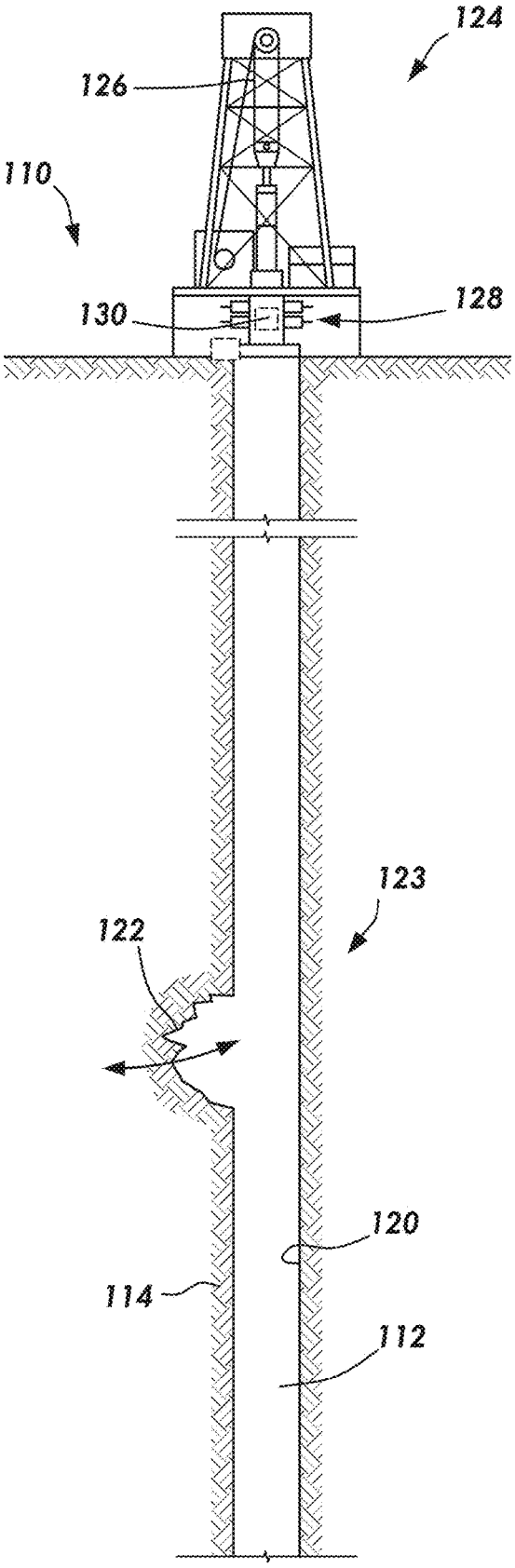

Referring now to FIG. 1B shown is an example of a well system 110, which is similar to well system 10 of FIG. 1A, or optionally the same but at a different depth. Well system 110 includes a wellbore 112 formed through a formation 114. In the example of FIG. 1B, the wellbore 112 is open-hole, and is not lined with casing or other tubulars along its sidewalls 120. An opening 122 is shown formed along an interface between the wellbore 112 and the formation 114 and represents where there is a discontinuity of mud cake lining the sidewalls 120, such as from a cavern, vugular formation, or fissure. The absence of mud cake at the opening 122 allows fluid communication between wellbore 112 and the surrounding formation 114 and defines a lost circulation zone 123. Well system 110 also includes a derrick 124 with a top drive 126, a wellhead assembly 128 and modules 130.

Figure 2B:
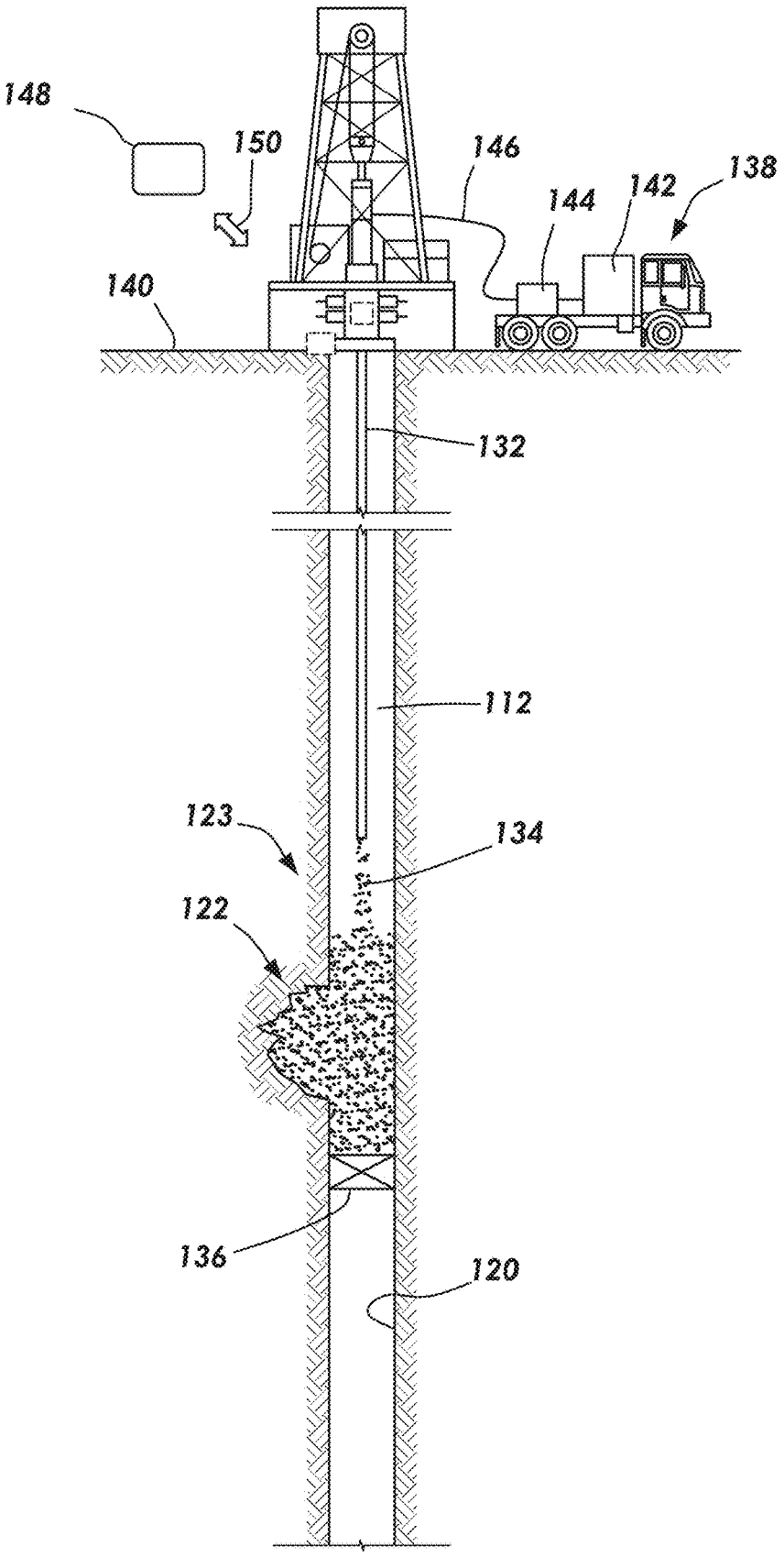
Figure 3B:
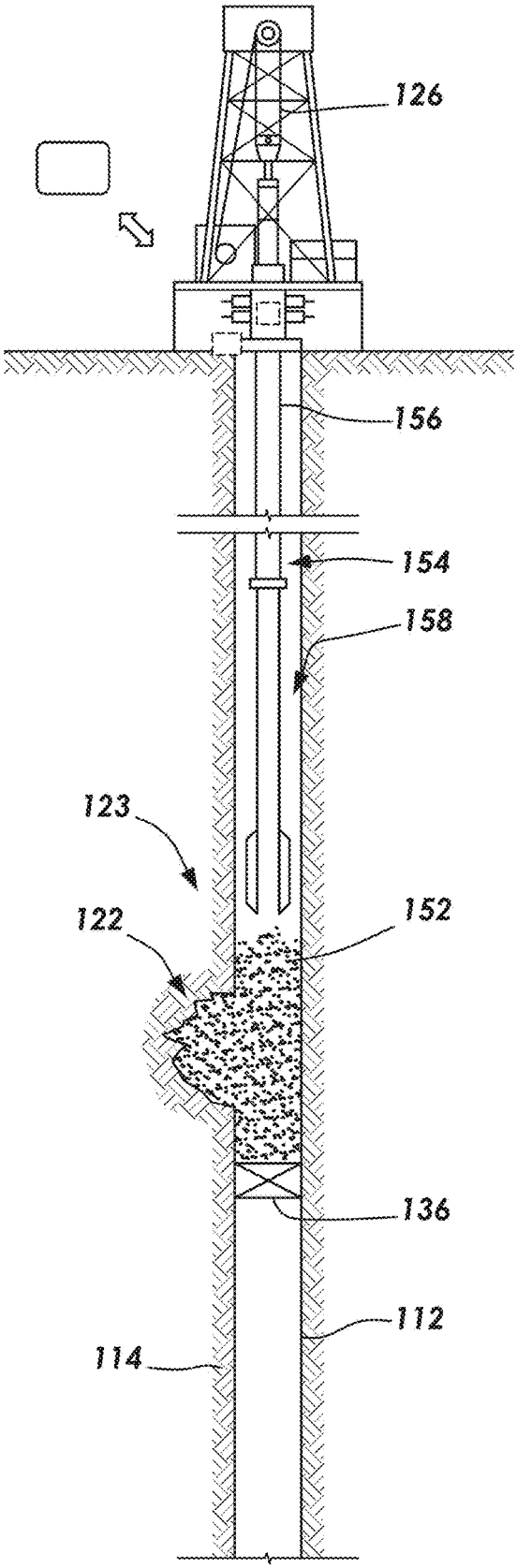

FIGS. 2B and 3B are similar to FIGS. 2A and 3A and which show tubing 132 being inserted into well 112 (FIG. 2B) for injecting a LPM 134 supported on a bridge plug 136. A service truck 138 on surface 140 includes a reservoir 142 with the LPM 134, and a pump 144 for urging the LPM 134 through a line 146 into the wellbore 112. LPM 134 is similar to LPM 34 (FIG. 2A) and in alternatives includes a eutectoid alloy, which in examples includes bismuth and tin and solidifies after being injected into the wellbore 112. A controller 148 generates instructions for components (not shown) in the wellbore 112, which are selectively transmitted downhole via communication means 150. Controller 148 optionally receives signals from within the wellbore 112 through communication means 150, in alternatives the signals represent information from downhole. In alternatives, a bridge plug 136 is not included, such as when a bottom of wellbore 112 is adjacent to or just downhole of lost circulation zone 122 of FIGS. 2B and 3B. Shown in FIG. 3B is that LPM 134 of FIG. 2B has solidified within wellbore 112 to form a plug 152 that occupies opening 122 and the portion of wellbore 112 adjacent opening 122 to form a barrier to fluid communication between wellbore 112 and formation 114 proximate zone 123. In alternative embodiments, the material making up the plug 52, 152 includes any material that is injectable into the wellbore 12, 112 in a liquified state so that it is flowable into zone 23, 123, and that solidifies inside the wellbore 12, 112 and inside zone 23, 123 into the plug 52, 152. Example materials include a composition that includes Portland cement.

Still referring to FIG. 3B, an example of a string assembly 154 is shown, which is made up of a pipe string 156 and a bit member 158 on a lower end of pipe string 156. Pipe string 156 is made up of a number of pipe joints in series that are joined end to end. In the illustrated example, string assembly 154 is being lowered within wellbore 112 to position that is adjacent an upper end of the plug 152. An example of bit member 58 (FIG. 3A) and an example of bit member 158 (FIG. 3B) are consolidated in FIG. 4. Bit member 58, 158, which are shown in a side partial sectional view, each include an annular main body 60, 160. Body 60, 160, which is elongate, has upper and lower end sections and a mid-section between the upper and lower end sections. An outer diameter of body 60, 160 is reduced along the mid-section. Extending helically around the outer surface of lower end section are profiles 62, 162, which project radially outward from the lower end section. In examples, profiles 62, 162 form a cutting structure of the bit member 58, similar to flutes on a drill bit used for construction, and which cut away material as the bit member 58 is rotated when in contact with the material. Spaced axially away from profiles 62, 162 and on the upper end section are profiles 64, 164 that extend helically along upper end section. Profiles 64, 164 have widths (transverse to the helical path) that are greater than widths of profiles 62, 162. Helical slots are defined between adjacent profiles 62, 162 and adjacent profiles 64, 164 to give each of the upper and lower end sections a fluted configuration. Flutes 64, 164 are centralizer flutes to allow centralization of the bit member 58 when cutting or excavating, but enable fluid and/or cuttings to pass by the outer surface of the bit member 58. An outer diameter of the mid-section is smooth and without profiles or undulations so that its outer diameter is substantially constant along its axial length.

Formed on lower end section is a bit portion 66, 166 having cutting elements 68, 168 that project axially away from upper end section. An annulus 70, 170 is shown extending within and along an axis $A_X$ of the body 60, 160. A lever 74, 174 is shown within a recess formed into an inner sidewall of annulus 70, 170. An end of the lever 74, 174 is pinned within recess and biased radially inward towards axis $A_X$ with a spring (not shown). A connection 72, 172 is formed on an end of body 60, 160 opposite from cutting element 68, 168, connection 72, 172 provides a place for attachment of the pipe joints 56, 156 to the bit member 58, 158. In an example, connection 72, 172 is a standard conical thread drill pipe connection.

Figure 4:
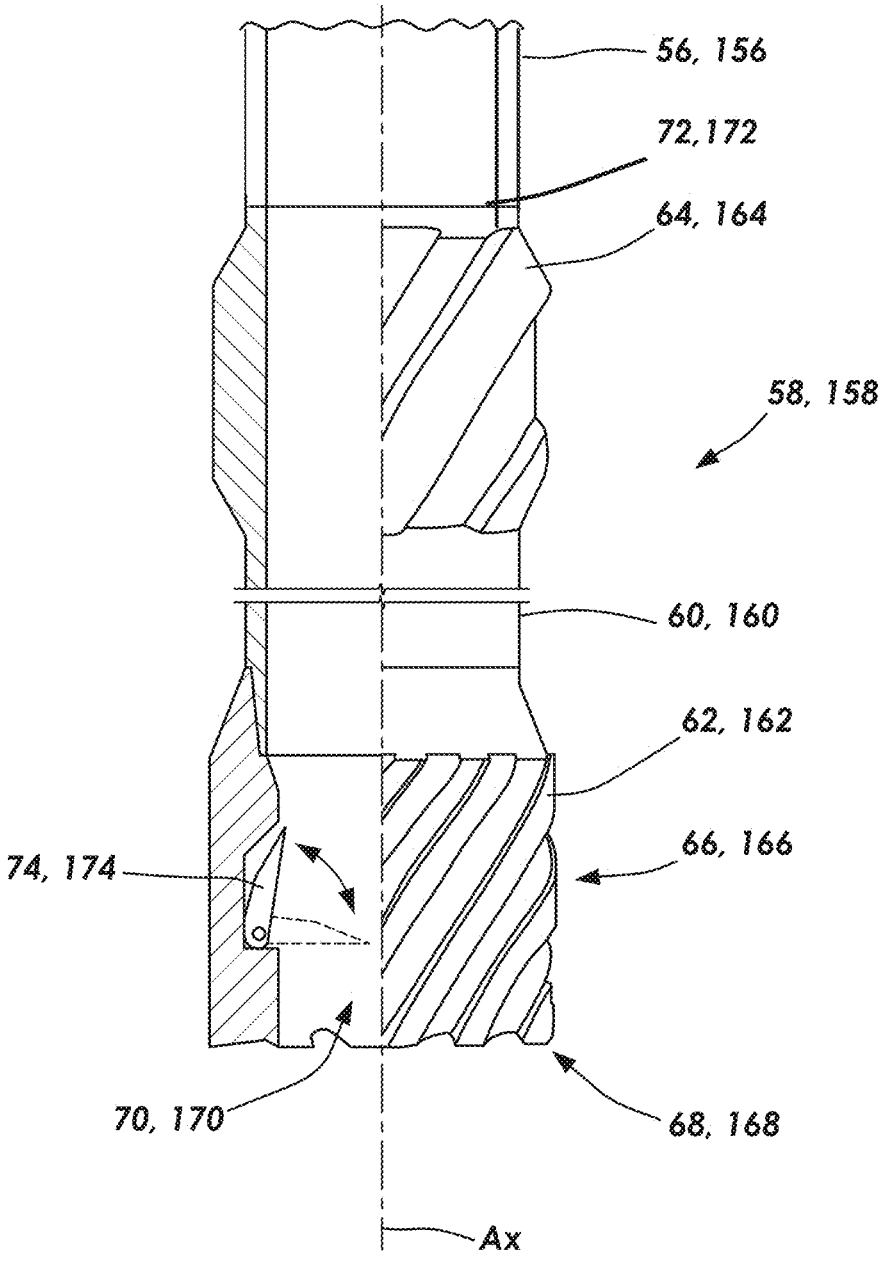
FIG. 4 is a side partial sectional view of example bit members for use with the pipe strings of FIGS. 3A and 3B.
Figure 5A:
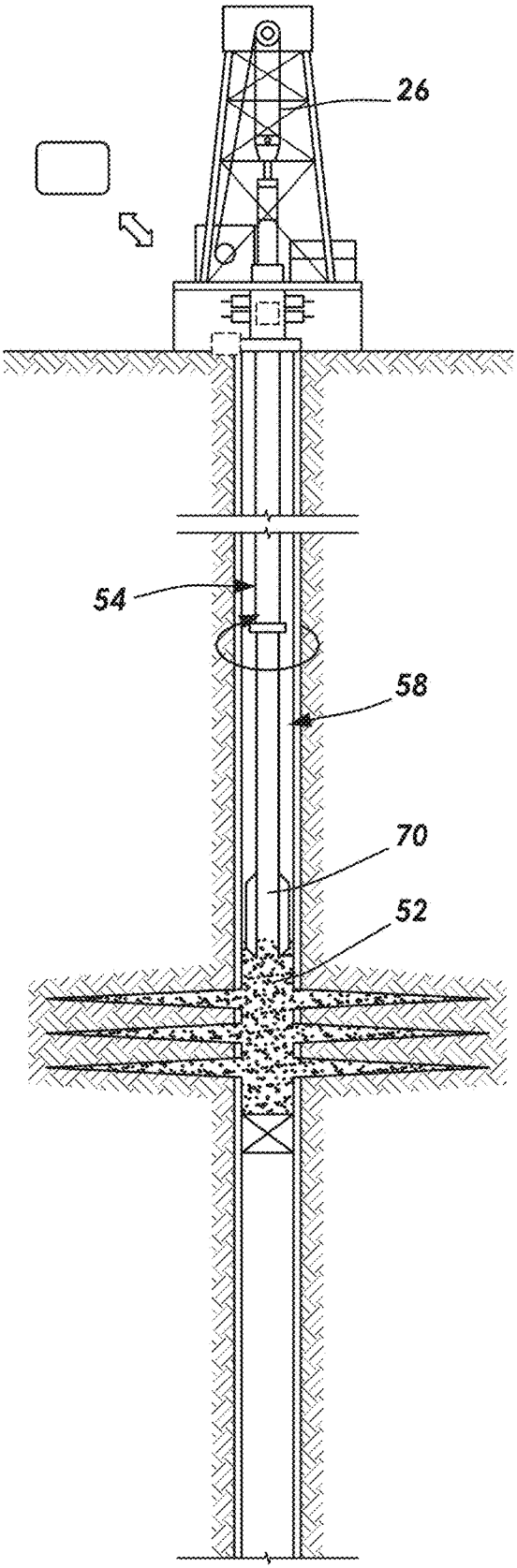
FIGS. 5A and 5B are side sectional views of engaging the plugs of FIGS. 2A and 2B with the bit members of FIG. 4.
Figure 5B:
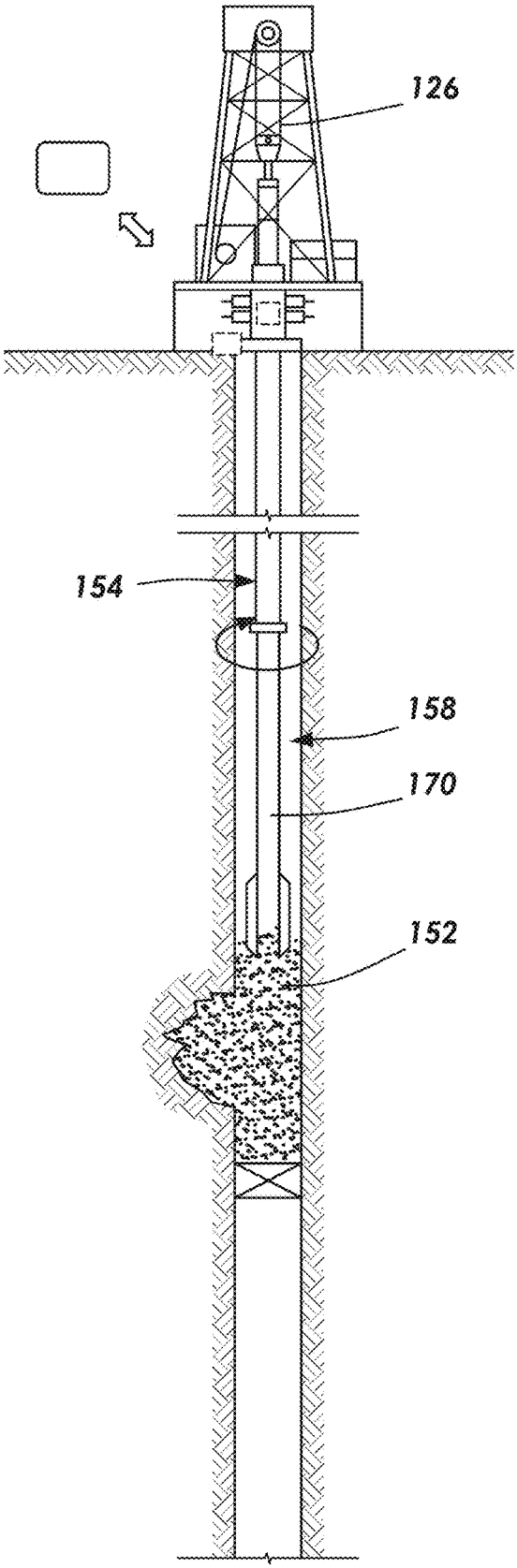
Figure 6A:
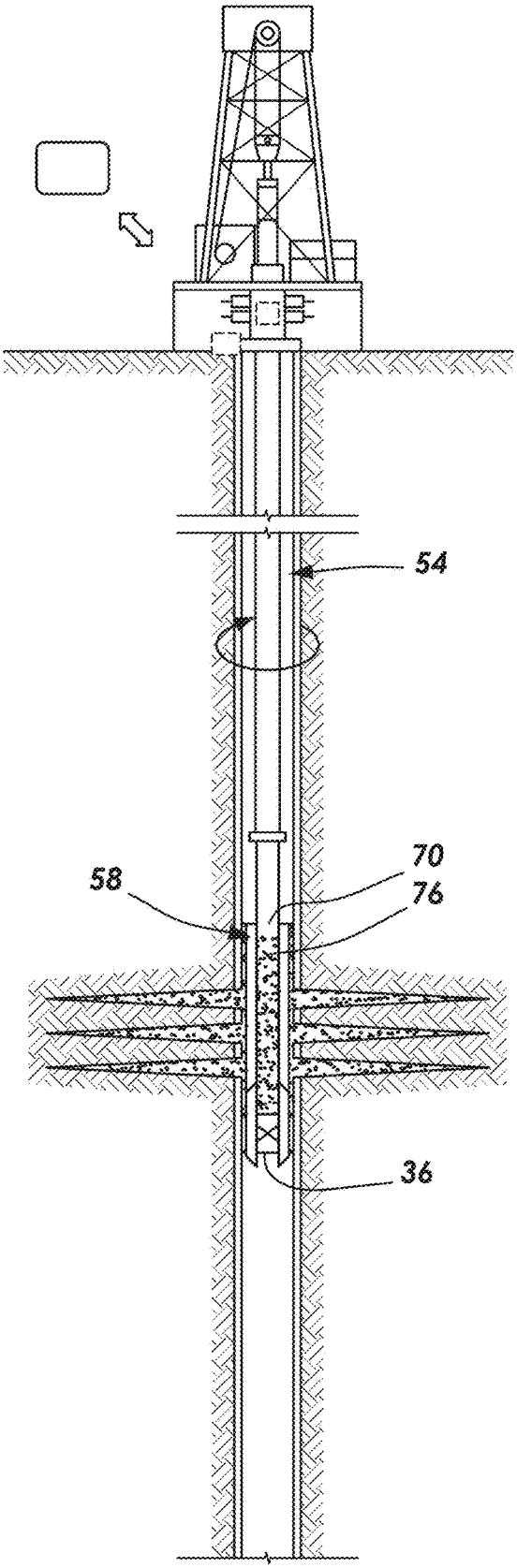
FIGS. 6A and 6B are side sectional views of coring through the plugs of FIGS. 2A and 2B with the bit members of FIG. 4.
Figure 6B:
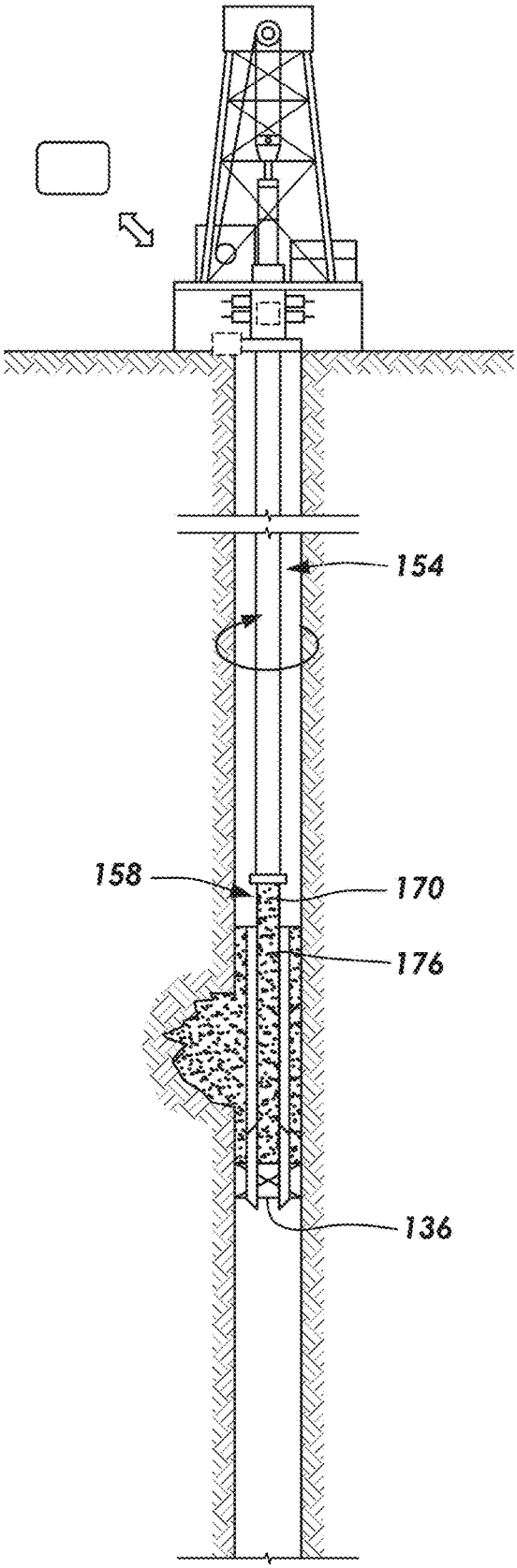

Shown in a side sectional view in FIGS. 5A and 5B are examples of using the string assembly 54, 154 to excavate through the plug 52, 152. In this example, drive system includes a top drive 26, 126 provides rotation of string assembly 54, 154, in combination with a downward force exerted onto string 54, 154 to engage cutting elements 68, 168 (FIG. 4) onto an upper surface of plug 52, 152. Alternatively, drive system includes a rotary table (not shown) on surface for exerting a rotational force onto string assembly 54, 154. As shown in FIG. 4, bit member 58, 158 is monolithic so that the inner and outer sidewalls rotate together with rotation of the body 60, 160, and, when rotating, all portions of the bit member 58, 158 rotate at the same rotational frequency. Referring now to FIGS. 6A and 6B, excavating through the plug 52, 152 forms a core 76, 176, where the core 76, 176 has an outer diameter that in examples extends up to about 75% of a diameter of the portion of the plug 52, 152 within wellbore 12, 112. In alternatives, the outer diameter of core 76, 176 ranges from around 60% to around 75% of outer diameter of plug 52, 152, and all values between around 60% to around 75%. In the example of FIG. 6A, the outer diameter of the portion of plug 52 within wellbore 12 is substantially the same as the inner diameter of the casing 16 (FIG. 2A); and in the example of FIG. 6B, the outer diameter of the portion of plug 152 within wellbore 112 is substantially the same as the inner diameter of the sidewalls of the wellbore 112 (FIG. 2B). Further in this example, core 76, 176 is received within the annulus 70, 170 of bit body 58, 158 as the rotation of bit member 58, 158 with applied downward force causes cutting elements 68, 168 to excavate the cylindrical core 76, 176 from within plug 52, 152, and also excavate through bridge plug 36, 136. Illustrated in the example of FIGS. 6A and 6B is that a portion of the bridge plug, 36, 136 is received within annulus 70, 170 and below core 76, 176.

For the purposes of discussion herein, an inner diameter defines a diameter of wellbore 12 (FIG. 1A) or wellbore 112 (FIG. 1B) of a fluid flow path, which for wellbore 12 of FIG. 1A is substantially equal to an inner diameter of casing 16, and for wellbore 112 of FIG. 1B is substantially equal to an inner diameter of sidewalls 120. A passable inner diameter, which is less than the inner diameter, defines a maximum diameter that an object can have and be insertable in the wellbore; which will be a lower value for wellbores lined with casing. Embodiments exist in which an outer diameter of the bit member 58, 158 is strategically dimensioned to have a passable inner diameter, and when inserted into the wellbore 12, 112, the outer surface of member 58, 158 is in sliding contact with inner diameters of wellbore 12, 112.

Figure 7A:
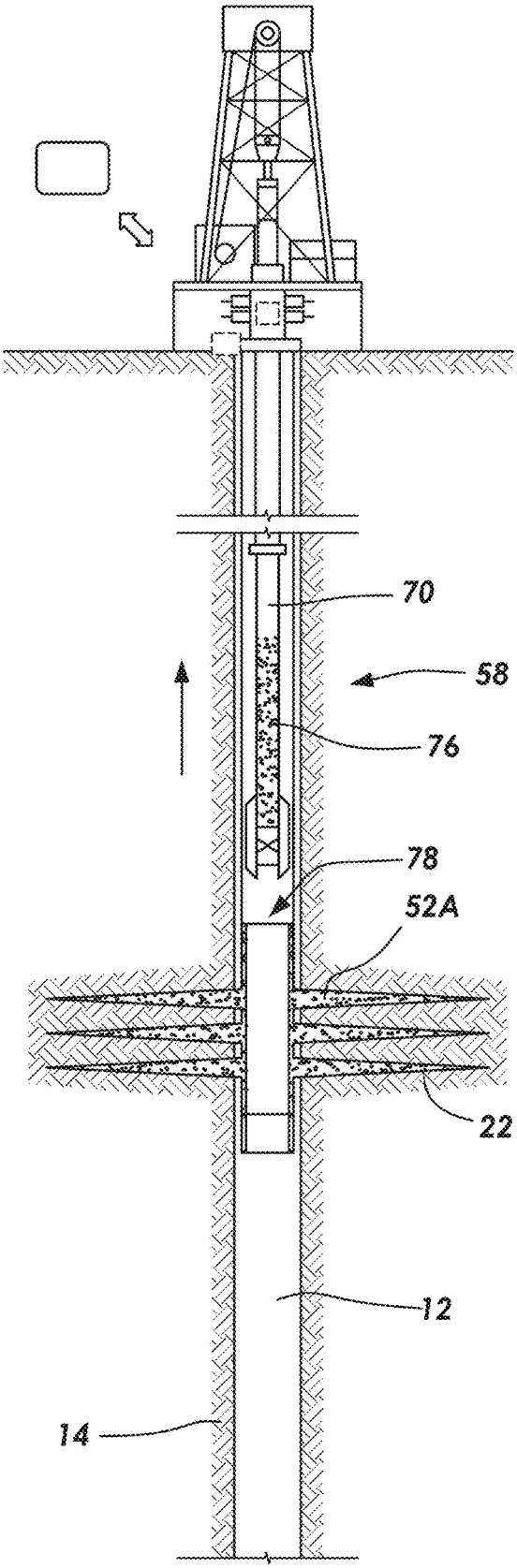
FIGS. 7A and 7B are side sectional views of retrieving plugs from the wellbores obtained by coring through the plugs.
Figure 7B:
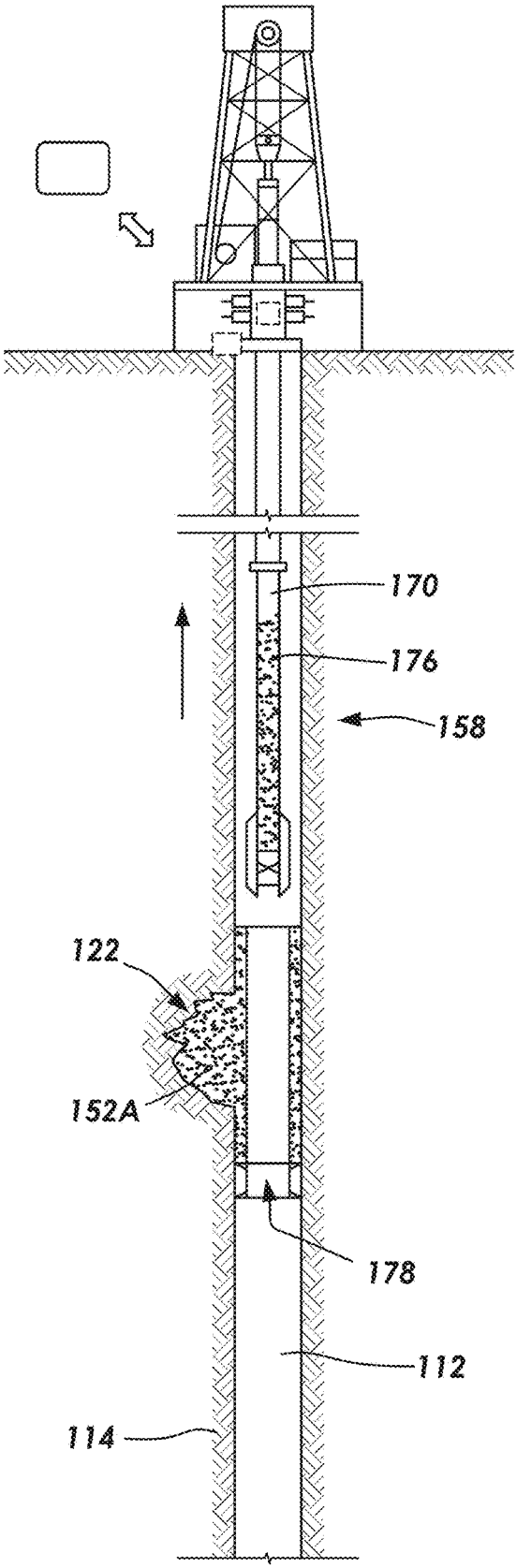

A subsequent step is illustrated in a side sectional view in FIGS. 7A and 7B, the core 76, 176 is retained within the annulus 70, 170 of bit member 58, 158 as the string assembly 54, 154 is pulled from within the wellbore 12, 112, and with core 76, 176 intact within the annulus 70, 170. Removing the core 76, 176 from plug 52, 152 results in a passage 78, 178 being formed axially through the resulting plug 52A, 152A, In examples, subsequent wellbore operations are performed in wellbore 12, 112 that include inserting tools (not shown) or tubulars through passage 78, 178 and at depths past the zone 23, 123. After removing core 76, 176, the remainder of plug 52A, 152A continues to be a barrier to fluid communication between formation 14, 114 and wellbore 12, 112. The core 76, 176 is optionally recycled and used for forming another plug, in accordance with that as described above, in wellbore 12, 112 or in a different wellbore. Advantages of the wellbore operations described herein include that lost circulation within a well can be remediated with a solid substance, which when removed from within the wellbore does not create cuttings or other debris that can accumulate within the well or recirculate uphole to potentially damage equipment on surface. An innovative feature of the bit body 58, 158 are the dimensions of the inner and outer diameters, which reduce the amount of cuttings created while forming the core 76, 176, yet provide ample dimensions for the tools to be inserted through passage 78, 178.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of operating in a wellbore comprising:

forming a plug in a portion of the wellbore having a lost circulation zone;

forming a core by excavating through the plug with an annular bit member that is configured so that the core has an outer diameter that ranges between around 75% to around 60% of an outer diameter of the plug within the wellbore;

extracting the core from the plug to define an axial passage through the plug; and removing the core from the wellbore.

2. The method of claim 1, wherein the annular bit member comprises upper and lower end sections with outer surfaces and profiles that project radially outward from the surfaces.

3. The method of claim 2, wherein the profiles comprise a plurality of profiles that are helically arranged and spaced apart from one another.

4. The method of claim 3, wherein the profiles comprise a fluted configuration and wherein widths of the profiles on the lower end section are different from widths of the profiles on the upper end section.

5. The method of claim 2, wherein the annular bit member comprises a mid-section between the upper and lower end sections, wherein outer diameters of the upper and lower end sections exceeds an outer diameter of the mid-section, and wherein an outer diameter of the mid-section is substantially constant along an axial length of the mid-section.

6. The method of claim 1, wherein the step of forming a plug comprises injecting a liquified plugging material ("LPM") into the wellbore, collecting the LPM in the portion so that the LPM flows from inside the wellbore into the lost circulation zone, and allowing the LPM to solidify.

7. The method of claim 1, wherein the plug comprises a eutectic alloy having bismuth and tin.

8. The method of claim 1 further comprising retaining the core within the annular bit by biasing an uphole end of a lever radially inward, wherein the lever is in a recess in a sidewall of the bit member and pivotingly secured in the recess on a downhole end with a pin.

9. The method of claim 1, further comprising inserting a downhole tool through the axial passage.

10. The method of claim 1, wherein the plug comprises a eutectic material, the method further comprising recycling the core for use in forming another plug.

11. A system for use in a wellbore comprising:

a string assembly comprising a pipe string;

an annular bit member on an end of the pipe string comprising, an annular body having an outer diameter strategically dimensioned to be in sliding contact with an inner diameter of the wellbore, a cutting end on a downhole end of the body, an annulus formed axially through the body that selectively receives a core as the cutting end is in cutting engagement with the plug, a bore extending axially through the body having a diameter that ranges between about 60% to about 75% of a passable inner diameter of the wellbore, and a retaining system in selective retaining contact with the core inside the bit; and a drive system in selective rotational coupling with the string assembly.

12. The wellbore system of claim 11, wherein the bit member is a monolithic member so that all portions of the bit member selectively rotate at the same rotational frequency.

13. The wellbore system of claim 11, wherein an inner surface of the bore has a continuous radius along an axial length of the bore.

14. The wellbore system of claim 11, wherein the annular bit member comprises a mid-section and upper and lower end sections projecting axially from opposing ends of the mid-section.

15. The wellbore system of claim 12, wherein the upper and lower end sections have outer diameters greater than an outer diameter of the mid-section and wherein the upper and lower end sections have profiles projecting radially outward from outer surfaces of the upper and lower end sections.

16. The wellbore system of claim 13, wherein the profiles comprise a plurality of profiles that are spaced away from one another and that extend helically along the outer surfaces of the upper and lower end sections.

17. The wellbore system of claim 13, wherein the profiles form a fluted configuration.

18. The wellbore system of claim 13, wherein widths of profiles on the lower end section are different from widths on the upper end section.

19. The wellbore system of claim 11, wherein the plug comprises a eutectoid alloy having bismuth and tin.

20. The wellbore system of claim 11, wherein the retaining system comprises a recess in a sidewall of the annulus of the bit, a lever in the recess this at selectively pivoted radially inward by a spring into engagement with the core.

* * * * *